US008757611B2

(12) United States Patent
Shih

(10) Patent No.: US 8,757,611 B2
(45) Date of Patent: Jun. 24, 2014

(54) SHEET-FEEDING APPARATUS EQUIPPED WITH PAPER PRESSING MECHANISM

(71) Applicant: Avision Inc., Hsinchu (TW)

(72) Inventor: Sheng-Yao Shih, Miaoli County (TW)

(73) Assignee: Avision Inc. (TW)

( * ) Notice: Subject to any disclaimer, the term of this patent is extended or adjusted under 35 U.S.C. 154(b) by 0 days.

(21) Appl. No.: 13/831,962

(22) Filed: Mar. 15, 2013

(65) Prior Publication Data

US 2014/0131939 A1 May 15, 2014

(30) Foreign Application Priority Data

Nov. 12, 2012 (TW) ..... 101221846 A

(51) Int. Cl.
*B65H 1/06* (2006.01)
*B65H 1/08* (2006.01)

(52) U.S. Cl.
USPC ..... 271/121; 271/126; 271/131; 271/137

(58) Field of Classification Search
USPC ..... 271/126, 131, 35, 23, 165, 121, 124, 271/125, 137, 138
See application file for complete search history.

(56) References Cited

U.S. PATENT DOCUMENTS 6,367,795 B1 * 4/2002 Matsuda et al. ..... 271/126
7,357,386 B2 * 4/2008 Shikan et al. ..... 271/10.09
7,621,522 B2 * 11/2009 Yasukawa et al. ..... 271/121
2013/0328261 A1 * 12/2013 Cheng ..... 271/126

FOREIGN PATENT DOCUMENTS

JP 09255167 A * 9/1997

* cited by examiner

*Primary Examiner* — Luis A Gonzalez

(57) ABSTRACT

A sheet-feeding apparatus includes a passage, a sheet-feeding roller disposed at an entrance of the passage, and a paper pressing mechanism including a paper pressing device and a driving mechanism. The driving mechanism drives the paper pressing device to move towards and away from the sheet-feeding roller. The driving mechanism includes a power source, a rotating shaft connected to the power source, and an arm attached to the rotating shaft. As the rotating shaft rotates in a first direction, the arm actuates the paper pressing device to move away from the sheet-feeding roller. As the rotating shaft rotates in a second direction, the arm releases the paper pressing device, so the paper pressing device moves towards the sheet-feeding roller and presses a paper sheet upon the sheet-feeding roller.

17 Claims, 9 Drawing Sheets

SHEET-FEEDING APPARATUS EQUIPPED WITH PAPER PRESSING MECHANISM

BACKGROUND OF THE INVENTION

1. Field of the Invention

The invention relates to a sheet-feeding apparatus and, more particularly, to a sheet-feeding apparatus equipped with a paper pressing mechanism.

2. Description of the Prior Art

As technology advances and develops, the sheet-feeding apparatuses, which are equipped with a sheet-feeding mechanism for feeding paper sheets into a paper path, (for example, machines like the scanner and printer) have become more widespread and popular. The sheet-feeding mechanism transports a paper sheet to and past a recording module (such as the image sensor for scanners and print head for printers) in order to produce scanned images or printed documents. If the sheet-feeding mechanism is not equipped with a special device for stabilizing the paper sheets on the paper tray, the single paper sheet being fed to the recording module may be misaligned and consequently the scanned image or the data on the printed document maybe skewed. The aforesaid phenomenon more often occurs on thin, soft or fluffy paper sheets, such as receipts and thermal papers.

SUMMARY OF THE INVENTION

Therefore, an objective of the invention is to provide a sheet-feeding apparatus equipped with a paper pressing mechanism, so as to solve the aforesaid problems.

According to an embodiment of the invention, a sheet-feeding apparatus comprises a passage, a sheet-feeding roller and a paper pressing mechanism. The sheet-feeding roller is disposed at an entrance of the passage. The paper pressing mechanism comprises a paper pressing device and a driving mechanism. The driving mechanism drives the paper pressing device to move towards and away from the sheet-feeding roller. The driving mechanism comprises a power source, a rotating shaft and an arm. The rotating shaft is connected to the power source. The arm is attached to the rotating shaft. As the rotating shaft rotates in a first direction, the arm actuates the paper pressing device to move away from the sheet-feeding roller. As the rotating shaft rotates in a second direction, the arm releases the paper pressing device, so the paper pressing device moves towards the sheet-feeding roller and presses a paper sheet upon the sheet-feeding roller.

By having the paper pressing mechanism in the sheet-feeding apparatus of the invention, problems like paper misalignment can be solved, no matter which type of paper is used.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
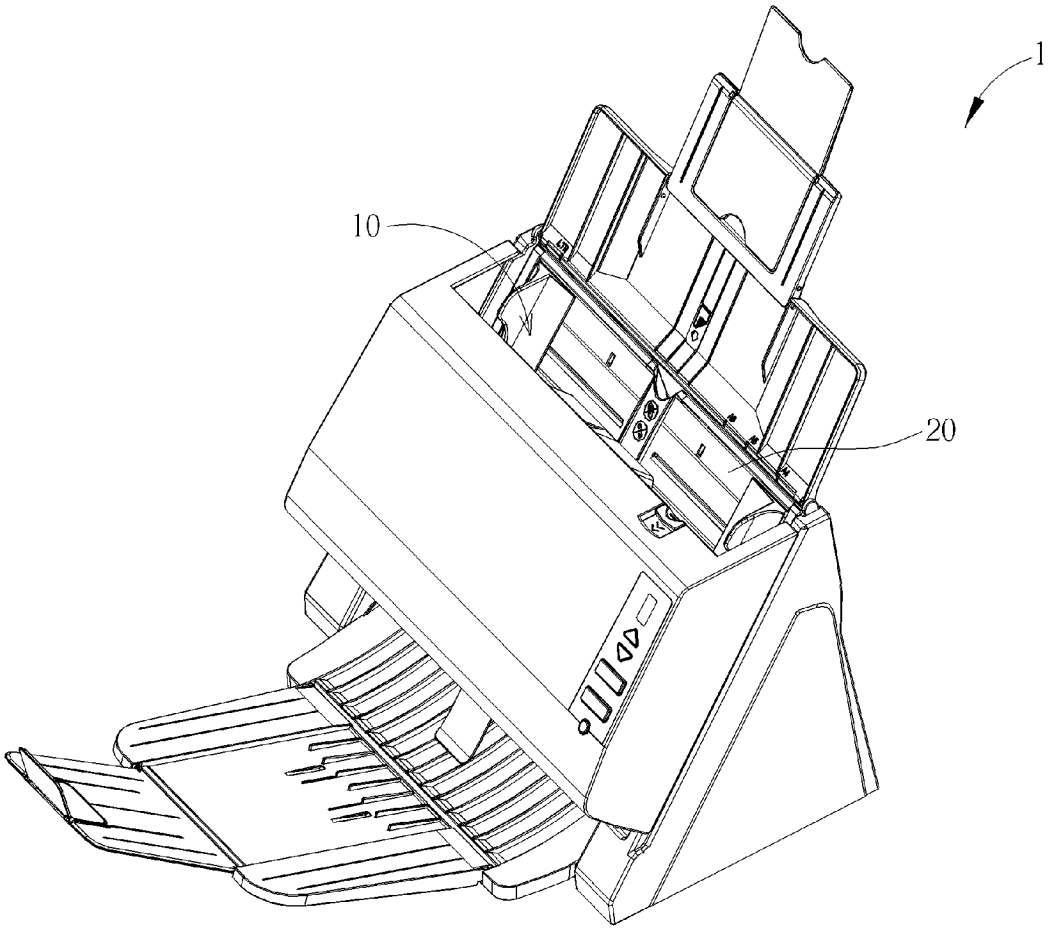
FIG. 1 is a perspective view of a sheet-feeding apparatus according to an embodiment of the invention.
Figure 2:
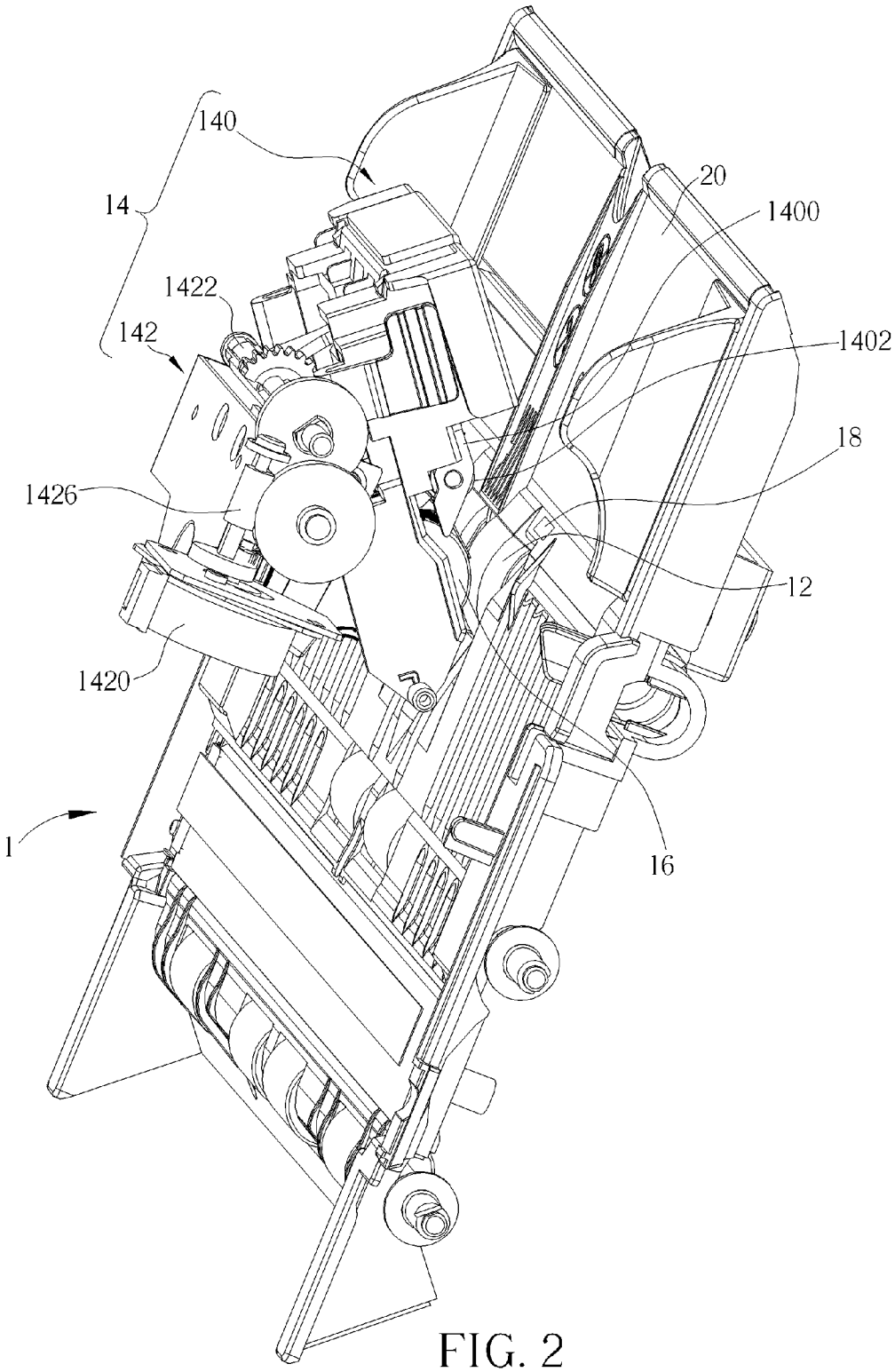
FIG. 2 is a schematic diagram illustrating the interior of the sheet-feeding apparatus shown in FIG. 1.
Figure 3:
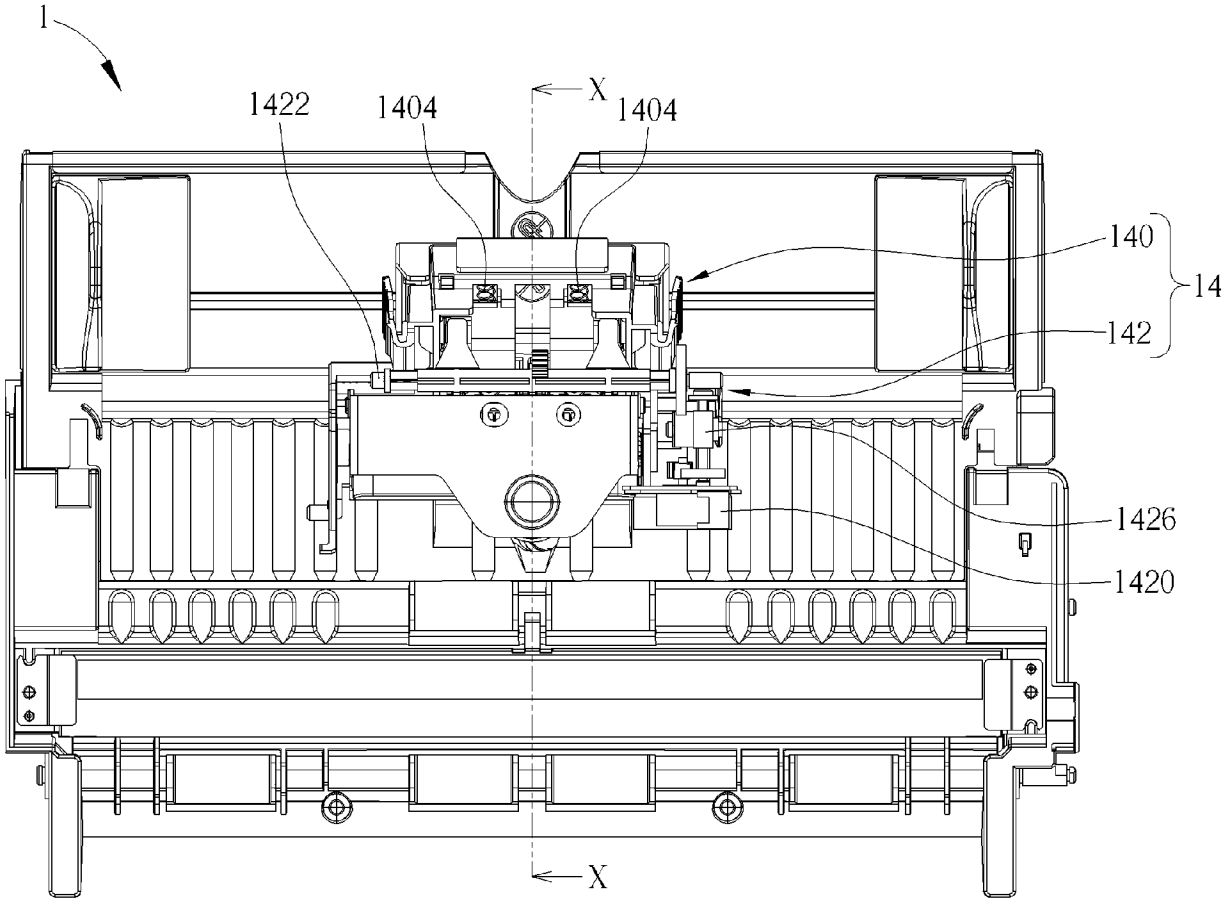
FIG. 3 is a top view of the sheet-feeding apparatus shown in FIG. 2.
Figure 4:
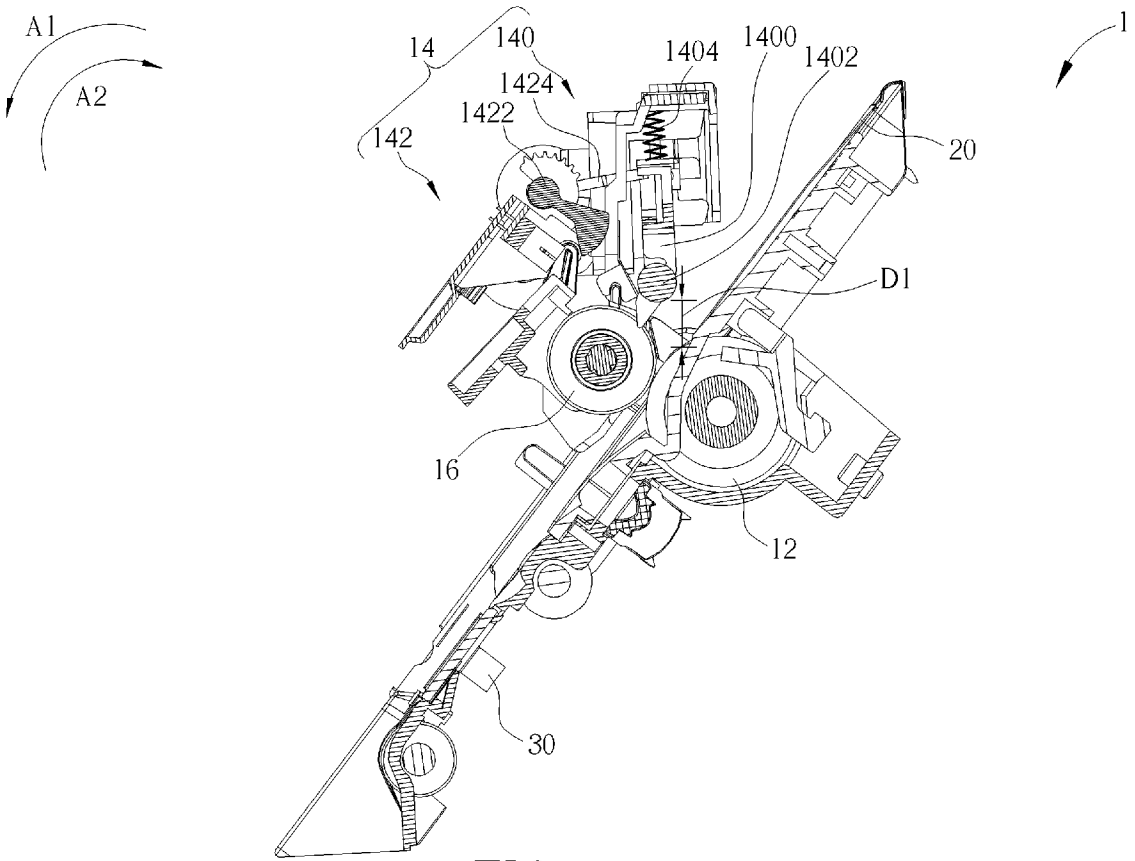
FIG. 4 is a cross-sectional view of the sheet-feeding apparatus along line X-X shown in FIG. 3, where the paper pressing device is spaced apart from the sheet-feeding roller by a separation.
Figure 5:
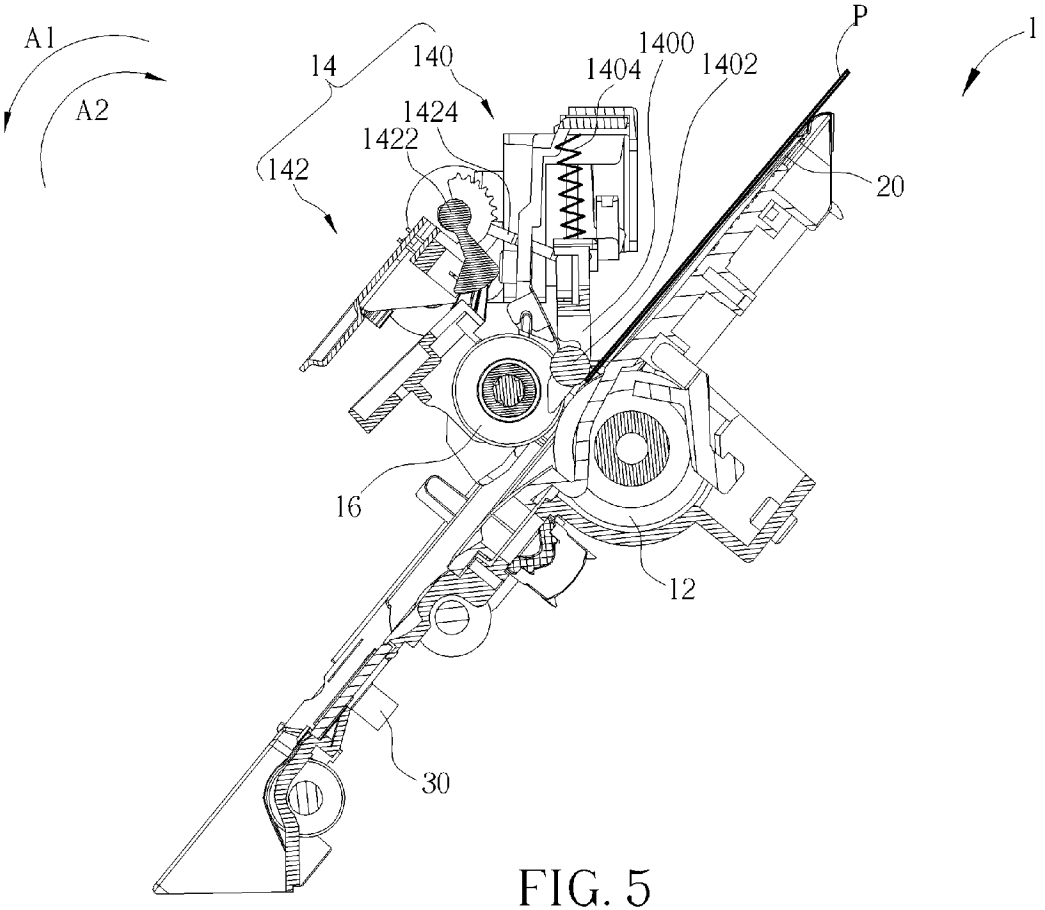
FIG. 5 is another cross-sectional view of the sheet-feeding apparatus shown in FIG. 4, where the paper pressing device presses a paper sheet upon the sheet-feeding roller.

Referring to FIGS. 1 to 5, FIG. 1 is a perspective view of a sheet-feeding apparatus 1 according to an embodiment of the invention; FIG. 2 is a schematic diagram illustrating the interior of the sheet-feeding apparatus 1 shown in FIG. 1; FIG. 3 is a top view of the sheet-feeding apparatus 1 shown in FIG. 2; FIG. 4 is a cross-sectional view of the sheet-feeding apparatus 1 along line X-X shown in FIG. 3, where the paper pressing device 140 is spaced apart from the sheet-feeding roller 12 by a separation D1; and FIG. 5 is another cross-sectional view of the sheet-feeding apparatus 1 shown in FIG. 4, where the paper pressing device 140 presses a paper sheet P upon the sheet-feeding roller 12.

As shown in FIGS. 1 to 5, the sheet-feeding apparatus 1 comprises a passage 10, a sheet-feeding roller 12, a paper pressing mechanism 14, a paper separation member 16, and a paper tray 20. In this embodiment, the sheet-feeding apparatus 1 is a scanner, so the sheet-feeding apparatus 1 further comprises an image sensing module 30 in the passage 10. The sheet-feeding apparatus 1 is not limited to the scanner and may also be other equipments with sheet-feeding function (for example, printers and multi-function business machines, etc.). The paper tray 20 and the sheet-feeding roller 12 are located at an entrance of the passage 10. The paper tray 20 is used for loading a paper sheet P (shown in FIG. 5). The sheet-feeding roller 12 is used for feeding the paper sheet P placed on the paper tray 20 into the passage 10. The paper separation member 16 is disposed opposite the sheet-feeding roller 12 and used to pinch the paper sheet P with the sheet-feeding roller 12, so as to feed paper sheets into the passage 10 one by one.

In this embodiment, the paper pressing mechanism 14 comprises a paper pressing device 140 and a driving mechanism 142. The driving mechanism 142 drives the paper pressing device 140 to move towards and away from the sheet-feeding roller 12. The driving mechanism 142 comprises a power source 1420, a rotating shaft 1422, an arm 1424 and a worm drive 1426. The arm 1424 is attached to the rotating shaft 1422 and turns in synchronization with the rotating shaft 1422. The power source 1420, such as a motor, is used to drive the rotating shaft 1422 and power the movement of the paper pressing device 140. In this embodiment, the rotating shaft 1422 is connected to the power source 1420 via the worm drive 1426, with which the direction of transmission is not reversible (and always from the power source 1420 to the paper pressing device 140), even when the paper pressing device 140 encounters resistance larger than that it can absorb. The paper pressing device 140 comprises a movable holder 1400, a pressing member 1402 and two first resilient members 1404. The first resilient members 1404 and the pressing member 1402 are disposed at opposite ends of the movable holder 1400. Each first resilient member 1404 is, but not limited to, a compression spring, and the pressing member 1402 is a rotary member including, but not limited to, a rotating wheel or a roller.

As shown in FIG. 4, the paper pressing device 140 is spaced apart from the sheet-feeding roller 12 by a separation D1, to allow placement of paper sheets on the paper tray 20. The separation D1 is configured according to the paper loading capacity of the sheet-feeding apparatus 1. In other words, the separation D1 is directly proportional to the paper loading capacity. For instance, if the paper tray 20 can be loaded with up to 100 pages of paper sheets, the separation D1 is at least equal to the thickness of the stack consisting of 100 pages. In this state of the paper pressing device 140, the first resilient member 1404 is compressed and storing energy.

As shown in FIG. 5, when the paper sheet P is placed on the sheet-feeding roller 12, the power source 1420 of the driving mechanism 142 drives the rotating shaft 1422 to rotate in a second direction A2, so as to drive the arm 1424 to turn in the second direction and release the movable holder 1400 of the paper pressing device 140. In response, the movable holder 1400 of the paper pressing device 140 moves towards the sheet-feeding roller 12 and presses the paper sheet P upon the sheet-feeding roller 12. At the same time, the first resilient member 1404 applies an urging force resulted from the preloaded energy on the movable holder 1400 and thereby the pressing member 1402 exerts a constant pressure on the paper sheet P. With the first resilient member 1404, the paper pressing device 140 executes the paper-pressing function effectively, preventing tilt or rotation of the paper sheet P. Furthermore, the paper pressing device 140 of this invention continuously abuts against the topmost paper sheet P with the pressing member 1404, as the paper sheets carried by the paper tray 20 gradually decrease in number and amount during the scanning process.

When the scanning process is completed and no paper is placed on the sheet-feeding roller 12, a processor (or a controller) (not shown) of the sheet-feeding apparatus 1 controls the power source 1420 to drive the rotating shaft 1422 to rotate in a first direction A1. The first direction A1 is opposite to the second direction A2. When the power source 1420 drives the rotating shaft 1422 to rotate in the first direction A1, the rotating shaft 1422 drives the arm 1424 to turn in the first direction A1 so as to actuate the movable holder 1400 of the paper pressing device 140 to move away from the sheet-feeding roller 12, such that the paper pressing device 140 and the sheet-feeding roller 12 are spaced apart by the separation D1, as shown in FIG. 4. At this time, the user can again place paper sheets on the paper tray 20 and the first resilient member 1404 is compressed to store energy.

In this embodiment, the sheet-feeding apparatus 1 is further equipped with a paper sensor 18 for detecting whether a paper sheet is placed on the sheet-feeding roller 12, and the detection and non-detection of paper sheets by the paper sensor 18 trigger the driving mechanism 142. The paper sensor 18 may be an electronic optical sensor, a photo-interceptor or a lever-arm reed sensor, and is disposed near the sheet-feeding roller 12 in order to detect the presence of the paper sheet P accurately. Alternatively, the driving mechanism 142 may also be controlled manually.

When the sheet-feeding apparatus 1 is shutting down, the processor of the sheet-feeding apparatus 1 controls the power source 1420 to drive the rotating shaft 1422 to rotate in the second direction A2, such that the arm 1424 attached to the rotating shaft 1422 also turns in the second direction A2 and releases the movable holder 1400 of the paper pressing device 140. In the process, the first resilient member 1404 is being restored to its normal form, as shown in FIG. 5. If the paper pressing device 140 is suspended at the upper position after the sheet-feeding apparatus 1 is shut down and the first resilient member 140 is kept under stress for a long interval, the first resilient member 1404 would develop an elastic fatigue.

Figure 6:
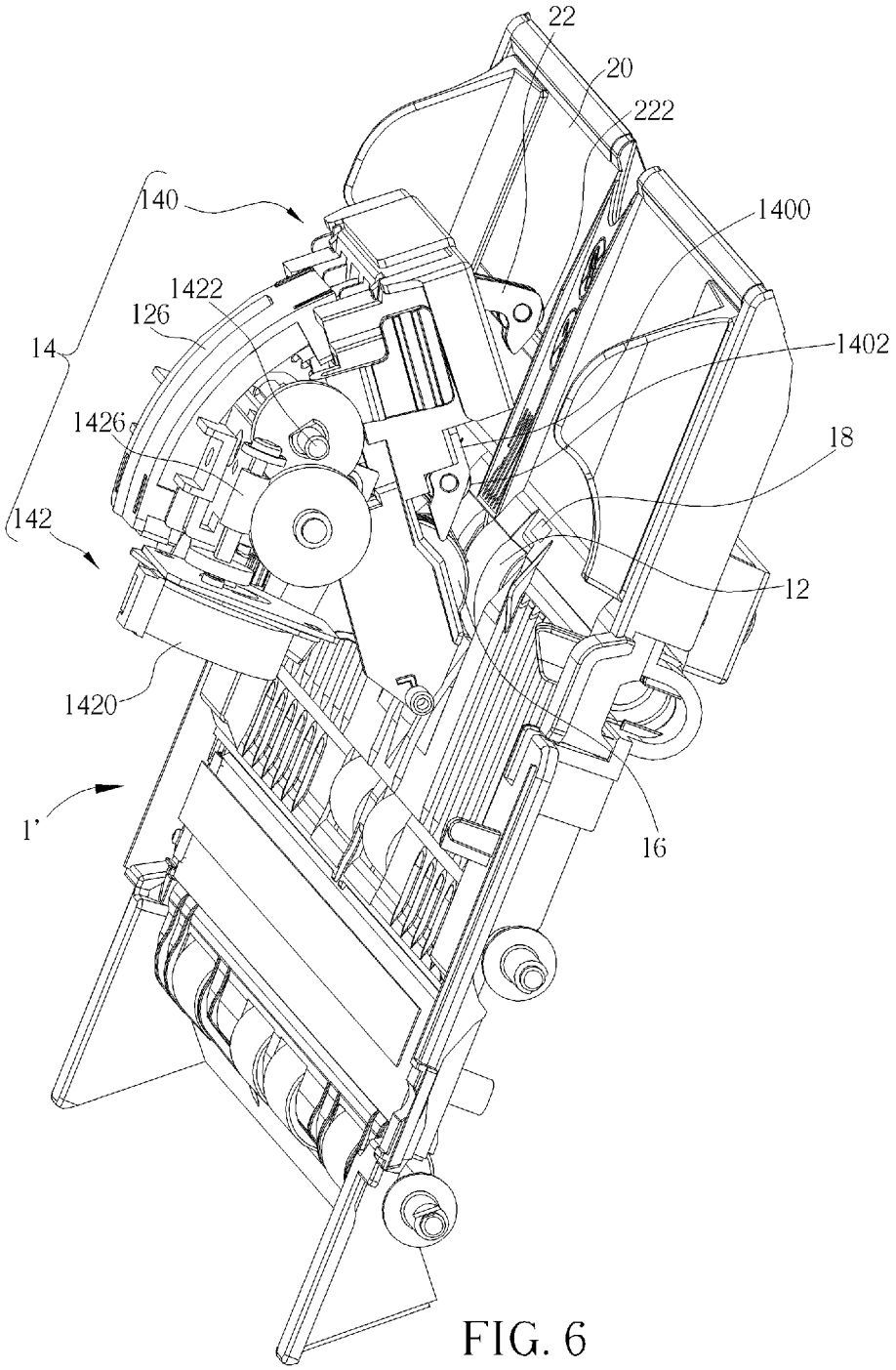
FIG. 6 is a schematic diagram illustrating the interior of a sheet-feeding apparatus according to another embodiment of the invention.
Figure 7:
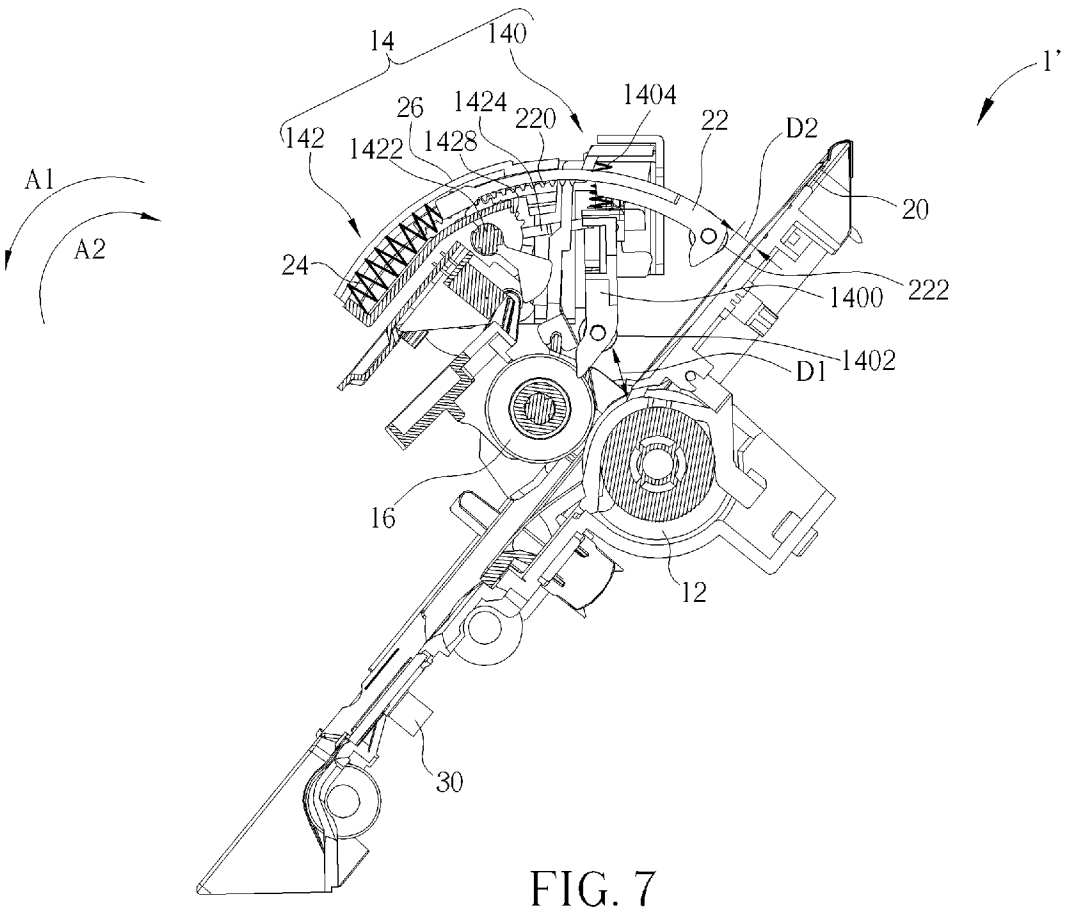
FIG. 7 is a cross-sectional view of the sheet-feeding apparatus shown in FIG. 6.
Figure 8:
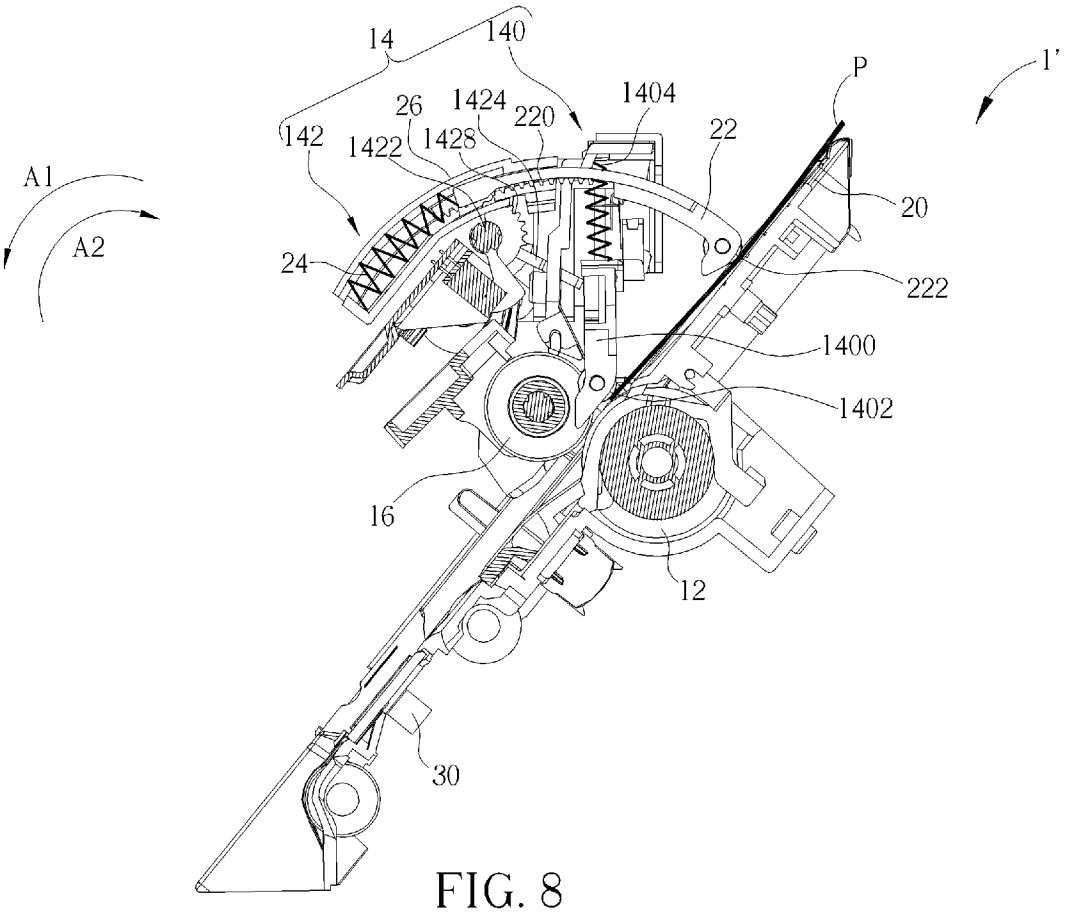
FIG. 8 is another cross-sectional view of the sheet-feeding apparatus shown in FIG. 7, where the paper pressing rod presses a paper sheet upon the paper tray.

Referring to FIGS. 6 to 8, FIG. 6 is a schematic diagram illustrating the interior of a sheet-feeding apparatus 1' according to another embodiment of the invention; FIG. 7 is a cross-sectional view of the sheet-feeding apparatus 1' shown in FIG. 6; and FIG. 8 is another cross-sectional view of the sheet-feeding apparatus 1' shown in FIG. 7, where a paper pressing rod 22 presses a paper sheet P upon the paper tray 20. The major difference between the sheet-feeding apparatus 1' and the aforesaid sheet-feeding apparatus 1 is that the sheet-feeding apparatus 1' further comprises a paper pressing rod 22, a second resilient member 24 and a channel track 26. It is noted that like or corresponding parts are identified by the same reference numerals as those used in FIGS. 2 to 5, and the repetitive description thereof will be omitted.

The paper pressing rod 22 is movably disposed opposite the paper tray 20. In this embodiment, the paper pressing rod 22 is installed in and guided by the channel track 26, where the paper pressing rod 22 can move forward and backward along the length of the channel track 26. The paper pressing rod 22 and the channel track 26 both are arc-shaped. In another embodiment, both of the paper pressing rod 22 and the channel track 26 may be linear. In other words, the shapes of the paper pressing rod 22 and the channel track 26 may vary according to practical applications and are not limited to the embodiment shown in the drawings herein. The second resilient member 24 is disposed in the channel track 26 and connected to an end of the paper pressing rod 22. In this embodiment, the second resilient member 24 may be, but not limited to, a compression spring. The paper pressing rod 22 has a toothed rack 220 and the rotating shaft 1422 has a cog wheel 1428. The cog wheel 1428 meshing with the toothed rack 220 drives the paper pressing rod 22 to move forward and backward relatively to the paper tray 20.

When the rotating shaft 1422 rotates, the rotating shaft 1422 drives not only the paper pressing device 140, but also the paper pressing rod 22. When the power source 1420 drives the rotating shaft 1422 to rotate in the first direction A1, the paper pressing rod 22 moves away from the paper tray 20 and is thereby spaced apart from the paper tray 20 by a separation D2. As shown in FIG. 7, in this state, all obstructions are cleared from the paper tray 20, which allows users to place paper sheets on the paper tray 20. And at this time, the second resilient member 24 is compressed and storing energy.

As shown in FIG. 8, when the power source 1420 drives the rotating shaft 1422 to rotate in the second direction A2, the paper pressing rod 22 moves towards the paper tray 20. The second resilient member 24 applies an urging force resulted from the preloaded energy on the paper pressing rod 22. The urging force applied on the paper pressing rod 22 other than facilitates the paper-pressing function of the paper pressing rod 22, also is utilized for continuously biasing the paper pressing rod 22 to press the paper sheet P when the paper pressing rod 22 is no longer powered by the rotating shaft 1422. In details, to ensure that the paper pressing rod 22 would not clash with the paper tray 20, the maximum extent of meshing engagement of the cog wheel 1428 with the toothed rack 220 is configured to be shorter than the maximum separation D2. If the toothed rack 220 is not meshed with the cog wheel 1428, the cog wheel 1428 is not able to steer the paper pressing rod 22. Thus, in the case that the paper sheets P on the paper tray 20 gradually are reduced to a few sheets during the scanning process (during which the paper pressing rod 22 moves closer and closer to the paper tray 20), due to the limited meshing engagement the cog wheel 1428 may not be able to drive the paper pressing rod 22 all the way down to abut upon the paper sheet P. Nonetheless, by the preloaded energy released by the second resilient member 24, the paper pressing rod 22 is pushed farther to the paper-pressing position. The paper pressing mechanism 14 further comprises a rotary member 222 (such as an idle roller, or wheel) mounted on a free end of the paper pressing rod 22, for abutting on the paper sheet P. Besides that the paper pressing rod 22 can correct the tilting or rotation of the paper sheet P by exerting a constant pressure on the paper sheet P, the rotary member 222, since rotating in favor of the movement of the paper sheet P, would not pull on the paper sheet or create ripples and tears.

By having the paper pressing device 140 and the paper pressing rod 22, the invention can prevent tilting of the paper sheet P and ensure that the paper sheet P passing the image sensing module 30 is not skewed. Furthermore, a friction generated between the paper pressing rod 22 and the paper sheet P can correct the advancing direction of the paper sheet P.

Figure 9:
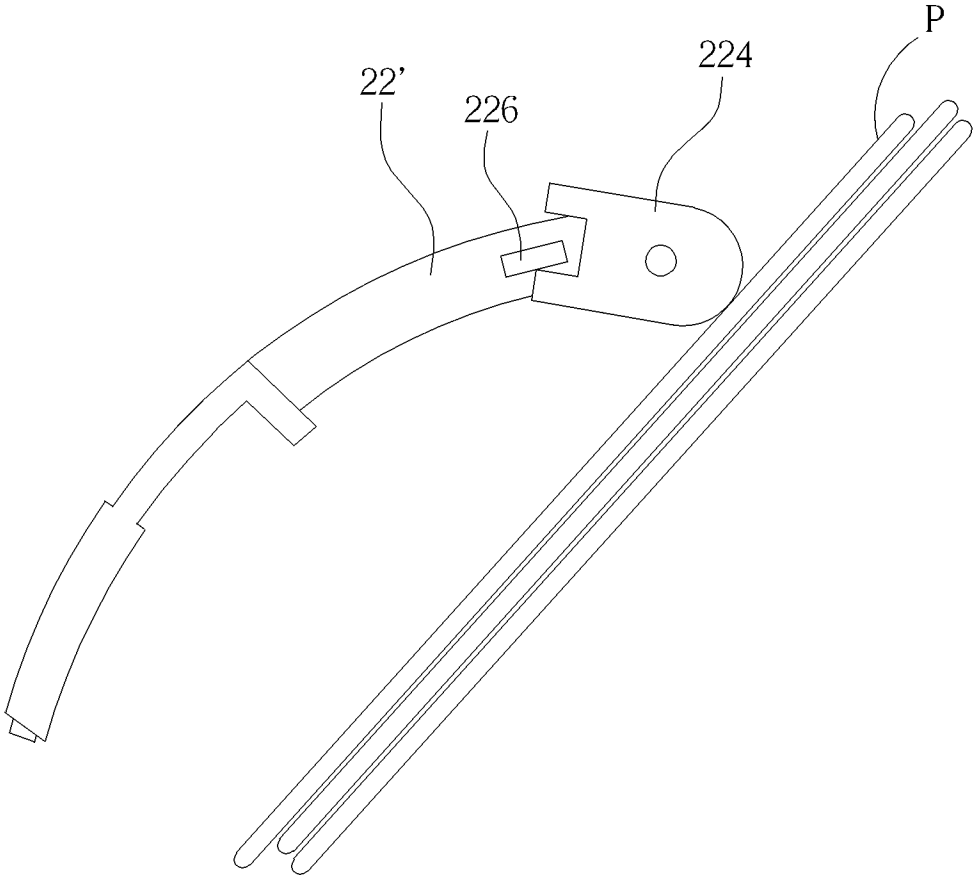
FIG. 9 is a schematic diagram illustrating a paper pressing rod according to another embodiment of the invention.

Referring to FIG. 9, FIG. 9 is a schematic diagram illustrating a paper pressing rod 22' according to another embodiment of the invention. The major difference between the paper pressing rod 22' and the aforesaid paper pressing rod 22 is that a rubbing part 224 and a stopper 226 are disposed on the paper pressing rod 22'. The rubbing part 224 is pivotally mounted on a free end of the paper pressing rod 22' and used to abut on the topmost paper sheet P. The stopper 226 is used to limit the movement (i.e., turning angle) of the rubbing part 224. The rubbing part 224 is capable of turning in the advancing direction of each paper sheet P; however, the turning angle is limited by the stopper 226. Generally speaking, paper sheets in motion tend to flutter. The rubbing part 224 is capable of suppressing the fluttering: the rubbing part 224, when being stopped by the stopper 226, generates a small drag force on the paper sheet P, and thereby suppresses the fluttering of the paper sheet P. In addition, the drag force generated by the rubbing part 224 and acting against the movement of the paper sheet P could also inhibit the tilting of the paper sheet P.

In comparison to the conventional art, the sheet-feeding apparatus of the invention utilizes the paper pressing mechanism to keep the paper sheet firmly pressing the sheet-feeding roller. Hence, the sheet-feeding roller could effectively transport the paper sheet in the destined direction, and the occurrence of paper misalignment during the paper feed would be avoided, no matter which type of paper is used. In addition, the paper pressing mechanism may also include a paper pressing rod for pinching the paper sheets with the supporting plate of the paper tray to prevent the tilting of the paper sheets.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A sheet-feeding apparatus comprising:

a passage;

a sheet-feeding roller located at an entrance of the passage; and a paper pressing mechanism comprising:

a paper pressing device; and a driving mechanism for driving the paper pressing device to move towards and away from the sheet-feeding roller, the driving mechanism comprising a power source, a rotating shaft and an arm, the rotating shaft being connected to the power source, the arm being attached to the rotating shaft;

wherein as the rotating shaft rotates in a first direction, the arm actuates the paper pressing device to move away from the sheet-feeding roller; and as the rotating shaft rotates in a second direction, the arm releases the paper pressing device, so the paper pressing device moves towards the sheet-feeding roller and presses a paper sheet upon the sheet-feeding roller; the sheet-feeding roller feeds the paper sheet in along a feeding path, and the paper pressing device and the driving mechanism are located at a same side of the feeding path; and wherein the paper pressing device comprises a movable holder and a pressing member, and the pressing member is disposed at an end of the movable holder, wherein as the rotating shaft rotates in the first direction, the arm actuates the movable holder to move away from the sheet-feeding roller; and as the rotating shaft rotates in the second direction, the arm releases the movable holder, so the movable holder moves towards the sheet-feeding roller.

2. The sheet-feeding apparatus of claim 1, further comprising a paper separation member disposed opposite the sheet-feeding roller.

3. The sheet-feeding apparatus of claim 1, wherein the paper pressing device further comprises a first resilient member, disposed at another end of the movable holder, for urging the movable holder towards the sheet-feeding roller when the arm releases the movable holder.

4. The sheet-feeding apparatus of claim 1, wherein the pressing member is a rotary member.

5. The sheet-feeding apparatus of claim 1, further comprising a paper sensor for detecting whether the paper sheet is placed on the sheet-feeding roller, wherein when the paper sensor detects no paper, the power source drives the rotating shaft to rotate in the first direction; and when the paper sensor detects the paper sheet, the power source drives the rotating shaft to rotate in the second direction.

6. The sheet-feeding apparatus of claim 1, wherein the paper pressing mechanism further comprises a paper pressing rod and a paper tray for loading the paper sheet, the paper pressing rod has a toothed rack and the rotating shaft has a cog wheel, wherein the cog wheel meshes with the toothed rack so as to drive the paper pressing rod to move; and wherein the rotating shaft rotating in the first direction drives the paper pressing rod to move away from the paper tray; and the rotating shaft rotating in the second direction drives the paper pressing rod to move towards the paper tray, so the paper pressing rod presses the paper sheet against the paper tray.

7. The sheet-feeding apparatus of claim 6, wherein the paper pressing mechanism further comprises a second resilient member disposed at an end of the paper pressing rod, wherein the second resilient member stores energy when the paper pressing rod is driven to move away from the paper tray and releases the preloaded energy when the paper pressing rod is driven to move towards the paper tray.

8. The sheet-feeding apparatus of claim 7, wherein when the paper pressing rod is driven to move towards the paper tray, the second resilient member applies an urging force to the paper pressing rod.

9. The sheet-feeding apparatus of claim 6, wherein the paper pressing rod is arc-shaped.

10. The sheet-feeding apparatus of claim 6, wherein the paper pressing mechanism further comprises a rotary member, mounted on a free end of the paper pressing rod, for abutting on the paper sheet.

11. The sheet-feeding apparatus of claim 6, wherein the paper pressing mechanism further comprises a rubbing part, pivotally mounted on a free end of the paper pressing rod, for abutting on the paper sheet, and a stopper, disposed on the paper pressing rod, for limiting movement of the rubbing part.

12. A sheet-feeding apparatus comprising:

a passage;

a sheet-feeding roller located at an entrance of the passage; and a paper pressing mechanism comprising:

a paper pressing device; and a driving mechanism for driving the paper pressing device to move towards and away from the sheet-feeding roller, the driving mechanism comprising a power source, a rotating shaft and an arm, the rotating shaft being connected to the power source, the arm being attached to the rotating shaft;

wherein as the rotating shaft rotates in a first direction, the arm actuates the paper pressing device to move away from the sheet-feeding roller; and as the rotating shaft rotates in a second direction, the arm releases the paper pressing device, so the paper pressing device moves towards the sheet-feeding roller and presses a paper sheet upon the sheet-feeding roller; the sheet-feeding roller feeds the paper sheet in along a feeding path, and the paper pressing device and the driving mechanism are located at a same side of the feeding path; and wherein the paper pressing mechanism further comprises a paper pressing rod and a paper tray for loading the paper sheet, the paper pressing rod has a toothed rack and the rotating shaft has a cog wheel, wherein the cog wheel meshes with the toothed rack so as to drive the paper pressing rod to move; and wherein the rotating shaft rotating in the first direction drives the paper pressing rod to move away from the paper tray; and the rotating shaft rotating in the second direction drives the paper pressing rod to move towards the paper tray, so the paper pressing rod presses the paper sheet against the paper tray.

13. The sheet-feeding apparatus of claim 12, wherein the paper pressing mechanism further comprises a second resilient member disposed at an end of the paper pressing rod, wherein the second resilient member stores energy when the paper pressing rod is driven to move away from the paper tray and releases the preloaded energy when the paper pressing rod is driven to move towards the paper tray.

14. The sheet-feeding apparatus of claim 13, wherein when the paper pressing rod is driven to move towards the paper tray, the second resilient member applies an urging force to the paper pressing rod.

15. The sheet-feeding apparatus of claim 12, wherein the paper pressing rod is arc-shaped.

16. The sheet-feeding apparatus of claim 12, wherein the paper pressing mechanism further comprises a rotary member, mounted on a free end of the paper pressing rod, for abutting on the paper sheet.

17. The sheet-feeding apparatus of claim 12, wherein the paper pressing mechanism further comprises a rubbing part, pivotally mounted on a free end of the paper pressing rod, for abutting on the paper sheet, and a stopper, disposed on the paper pressing rod, for limiting movement of the rubbing part.

* * * * *